US008297992B2

(12) United States Patent
Park

(10) Patent No.: US 8,297,992 B2
(45) Date of Patent: Oct. 30, 2012

(54) ELECTRICAL CONNECTOR ASSEMBLY HAVING LOCKING DEVICE

(75) Inventor: Joo Hyun Park, Osan-si (KR)

(73) Assignee: FCI Automotive Holding, Guyancourt (FR)

( * ) Notice: Subject to any disclaimer, the term of this patent is extended or adjusted under 35 U.S.C. 154(b) by 0 days.

(21) Appl. No.: 12/998,196

(22) PCT Filed: Sep. 18, 2009

(86) PCT No.: PCT/IB2009/055091

§ 371 (c)(1), (2), (4) Date: May 9, 2011

(87) PCT Pub. No.: WO2010/035247

PCT Pub. Date: Apr. 1, 2010

(65) Prior Publication Data

US 2012/0015547 A1 Jan. 19, 2012

(30) Foreign Application Priority Data

Sep. 26, 2008 (WO) ..... PCT/IB2008/055627

(51) Int. Cl.
*H01R 13/62* (2006.01)

(52) U.S. Cl. ..... 439/157

(58) Field of Classification Search ..... 439/157, 439/347, 489, 752, 595, 701
See application file for complete search history.

(56) References Cited

U.S. PATENT DOCUMENTS

| | | | | |
|---|---|---|---|---|
| 5,904,583 | A * | 5/1999 | Katsuma et al. | 439/157 |
| 7,524,200 | B2 * | 4/2009 | Ikeya et al. | 439/157 |
| 2004/0097113 | A1 | 5/2004 | Shinozaki et al. | 439/157 |
| 2004/0229485 | A1 | 11/2004 | Cloarec et al. | 439/157 |
| 2008/0090435 | A1 * | 4/2008 | Ikeya et al. | 439/157 |
| 2008/0102668 | A1 * | 5/2008 | Ikeya et al. | 439/157 |

FOREIGN PATENT DOCUMENTS

EP 1 903 641 A1 3/2008

* cited by examiner

*Primary Examiner* — Tulsidas C Patel
*Assistant Examiner* — Phuongchi Nguyen
(74) *Attorney, Agent, or Firm* — Harrington & Smith

(57) ABSTRACT

An electrical connector assembly includes first and second connectors connectable to each other. The first connector has a first housing and a locking lever detachably and movably coupled thereto. The second connector has a second housing and a pair of protuberances formed on external surface of the second housing. When the locking lever is at an open position, first and second connectors are ready to be connected together. When the locking lever moves away from the open position towards a close position, the first and second connectors are guided by the locking lever to connect together and are prevented from being separated. A pair of stoppers are formed on the locking lever which engages the first housing to lock the lever at the open position. When the second connector is inserted into the first connector, the stoppers are released to allow the locking lever to move towards the close position.

17 Claims, 5 Drawing Sheets

ELECTRICAL CONNECTOR ASSEMBLY HAVING LOCKING DEVICE

TECHNICAL FIELD

The present invention relates to an electrical connector assembly having two counterpart connectors. In particular, it relates to an electrical connector assembly having a locking device for securing the connection of the two counterpart connectors.

BACKGROUND

In certain industrial applications, electrical connectors are required to be securely connected and maintained at the connected position by locking to each other. These electrical connecter are typically provided with locking structure such as latches to lock the connector housings to each other.

In conventional connector assemblies, a locking device is attached, to one of the connectors and the locking device is at an open position before the two counterpart connectors are mated. After the two connectors are mated, the locking device is moved to the lock position so as to lock the two connectors together. The locking may move by itself to the locked position before the two connectors are mated, therefore causing difficulties of the mating process or at least reducing the efficiency of the assembling process.

It is therefore a need to provide a connector assembly with a locking device which will be kept at the open position before the two counterpart connectors are connected together and mated.

SUMMARY OF INVENTION

Embodiments of the present invention provide an electrical connector assembly which includes first and second connectors connectable to each other. The first connector has a first housing and a locking lever moveably coupled to the first housing via a first pair of cam grooves formed on the locking lever. The locking lever is movable relative to the first housing between an open position and a close position. The second connector has a second housing and a pair of protuberances formed on external surface of the second housing. When the locking lever is at the open position, the first and second connectors are ready to be connected together and when the locking lever moves away from the open position towards the close position, the first and second connectors are guided by the locking lever to connect together and are prevented from being separated by the engagement of a second pair of grooves formed on the locking lever and the protuberances.

In one embodiment, a pair of stoppers are formed on the locking lever which engages the first housing to lock the locking lever at the open position. When the second connector housing is inserted into the first connector housing, the stoppers are released to allow the locking lever to move away from the open position towards the close position. The locking lever can also be locked at the close position by a latch formed on the first housing, such that the locking lever can only move away from the close position by manually releasing the latch.

In another embodiment, the locking lever is rotatable about a pair of guide pivots formed on side plates of the locking lever. The guide pivots engage with guide grooves formed on the first housing. During rotation of the locking lever, the guide pivots slide along the guide grooves, so as to improve the operability of the locking lever.

Other aspects and advantages of the present invention will become apparent from the following detailed description, taken in conjunction with the accompanying drawings, illustrating by way of example the inventive concept of the present invention.

BRIEF DESCRIPTION OF THE DRAWINGS

These and other aspects and advantages of the present invention will be described in detail with reference to the accompanying drawings, in which.

DETAILED DESCRIPTION OF THE PREFERRED EMBODIMENTS

Figure 1:
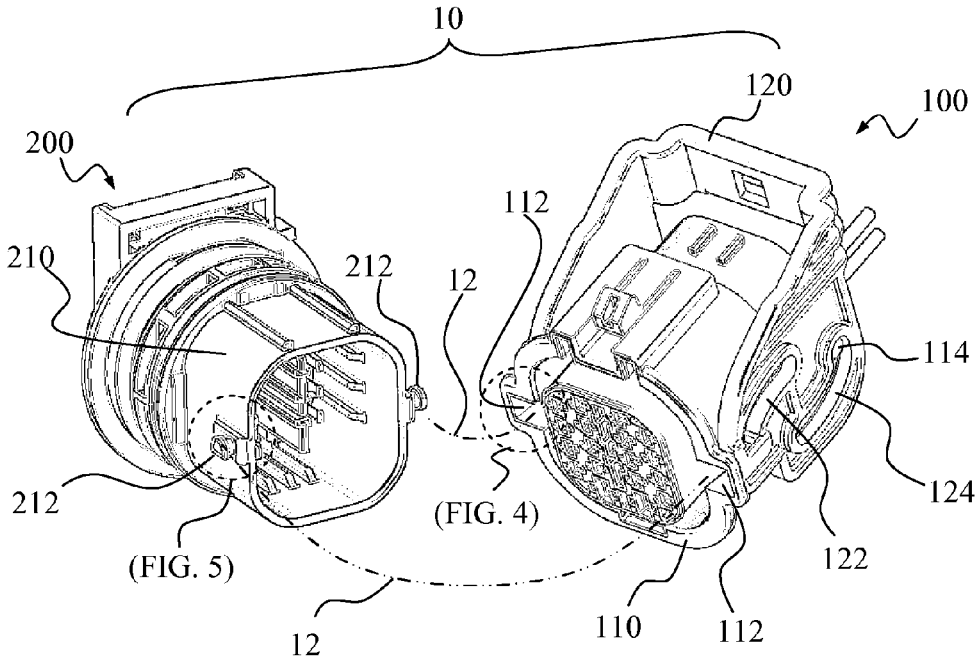
FIG. 1 is a perspective view showing an electrical connector assembly according to one embodiment of the present invention.

As shown in FIG. 1, an electrical connector assembly 10 according to one embodiment of the present invention includes a first connector 100, a counterpart second connector 200, for connecting to each other to establish an electrical connection. First connector 100 has a first housing 110 and a locking lever 120 detachably and movably connected to first housing 110. Second connector 200 has a second housing 210 and a pair of protuberances 212 projecting outwardly from second housing 210.

Figures 2, 3:
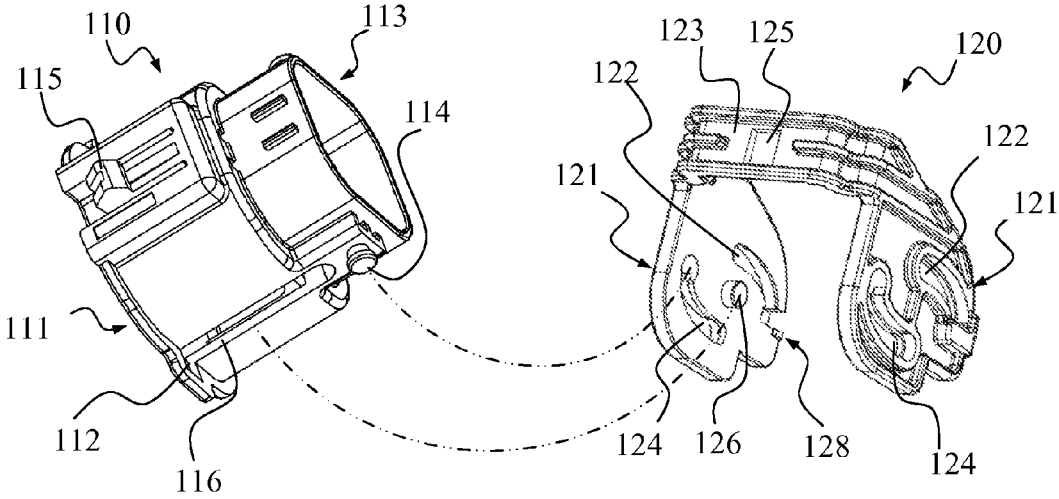
FIG. 2 is a perspective view showing a first connector of the electrical connector assembly of FIG. 1.
FIG. 3 is a perspective view showing a locking lever to be assembled to the first connector of FIG. 2.

First housing 110 has a pair of guide grooves 116 (only one is shown in FIG. 2) formed at its left and right sides. Each guide groove 116 has an end opening 112 at front end 111 of first housing 110. At rear end 113 of first housing 110, there are formed a pair of support pivots 114 coaxially positioned and projecting outwardly from the left and right sides of first housing 110. At top side of first housing 110, there is formed a latch 115.

FIG. 3 shows locking lever 120 from a rear side of FIG. 1. As shown in FIG. 3, locking lever 120 has a pair of side plates 121 joint at one end by a cross bar 123, forming a generally U-shaped structure. An opening 125 is formed at the middle portion of cross bar 123. Each side plate 121 has a locking groove 122, a support groove 124 and a guide pivot 126 between locking groove 122 and support groove 124, and projecting inwardly from side plate 121. The pair of guide pivots 126 are positioned coaxially and facing each other. Each side plate 121 further includes a stopper 128 projecting inwardly at an end portion of locking groove 122.

Figure 4:
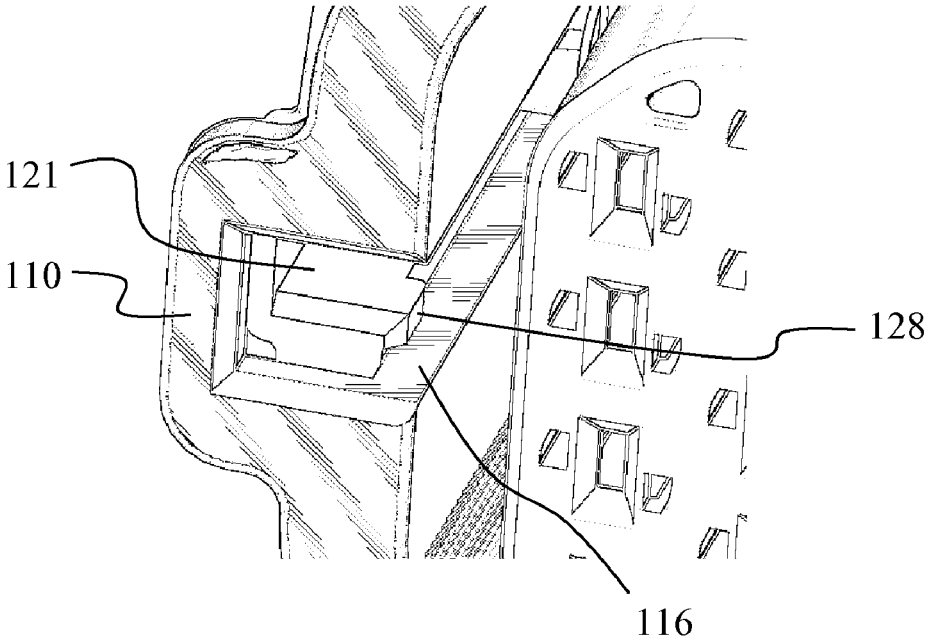
FIG. 4 is an enlarged partial perspective view of FIG. 1 showing the locking lever being locked at open position.

Locking lever 120 is made in one-piece by molding. The pair of side plates 121 are allowed to resiliently bent toward and away from each other, within a certain degree of deflection range, without broken off from cross bar 123. When locking lever 120 is to be assembled to first housing 110, side plates 121 are slightly bent away from each other such that first housing 110 can be inserted between side plates 121, with each of the guide pivots 126 positioned in a corresponding guide groove 116. In the meantime, each support pivot 114 is positioned in a corresponding support groove 124 of locking lever 120. In addition, as shown in FIG. 4, stoppers 128 (only one is shown in FIG. 4) act against side wall of guide groove 116 of first housing 110. By this arrangement, before first and second connectors 100 and 200 are connected, locking lever 120 can be locked to first housing 110, as shown in FIG. 1. This configuration ensures that first connector 100 is in a ready-to-mate situation with counterpart second connector 200, and locking lever 120 will not be moved toward locking position before counterpart second connector 200 is connected to first connector 100.

Figure 5:
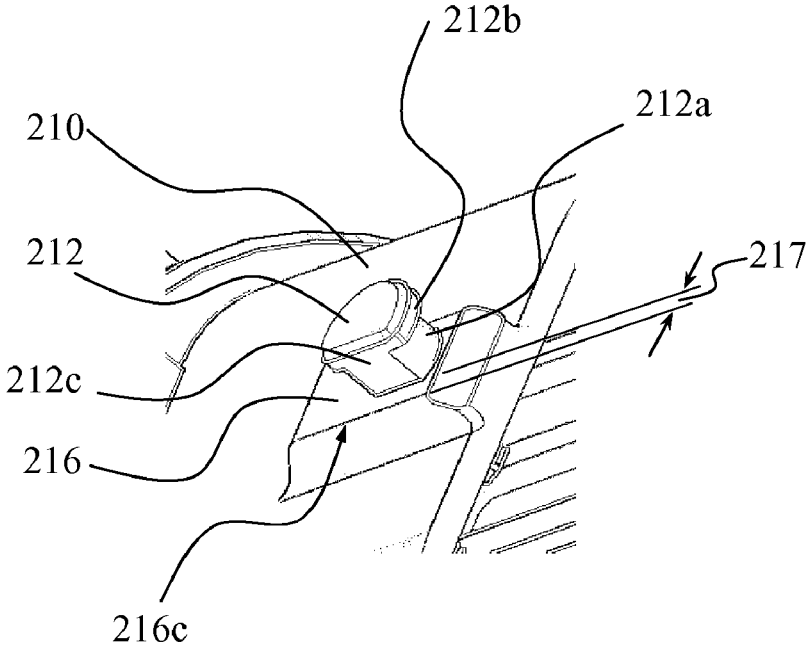
FIG. 5 is an enlarged partial perspective view of the second connector of FIG. 1.

FIG. 5 is a partial enlarged view of FIG. 1, viewing from a different angle, showing details of a locking protuberance 212 of second connector housing 210. At external surface of second connector housing 210, there are formed a pair of bosses 216 and on top of each boss 216, a protuberance 212 is formed. Each protuberance 212 has a neck portion 212*a* connecting to boss 216, and an enlarged end portion 212*b*. Protuberance 212 is generally cylindrical shape, and with one side partially cut away, forming a flat side surface 212*c* and a space 217 between flat side surface 212*c* and edge 216*c* of boss 216.

Figure 6A:
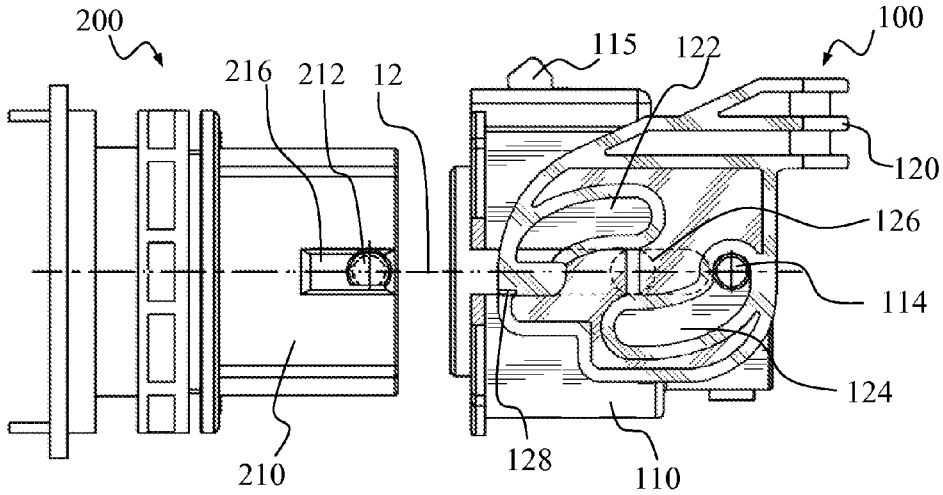
FIG. 6A is a front view showing the electrical connector assembly of FIG. 1 before the two connectors are mated.
Figure 6B:
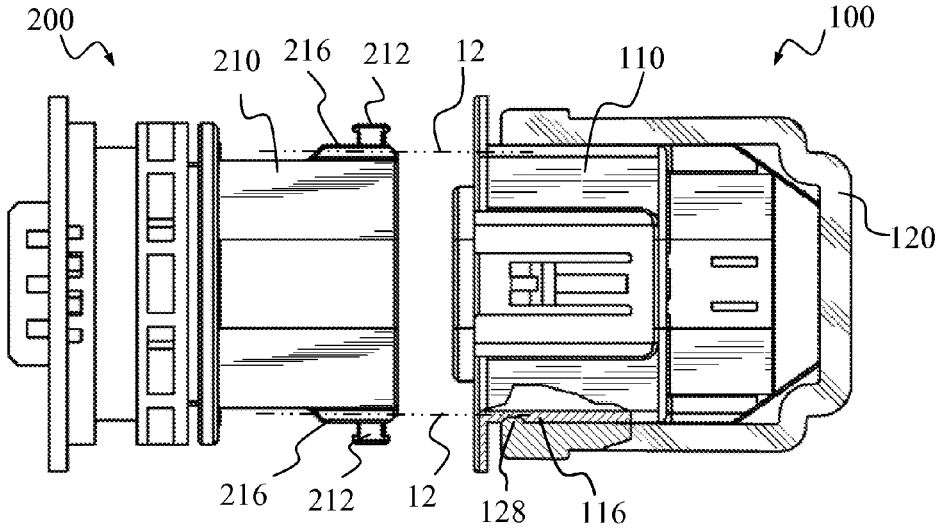
FIG. 6B is a partial cross sectional top view of FIG. 6A.

As shown in FIGS. 6A and 6B, before connectors 100 and 200 are connected, stopper 128 engages guide groove 116, which prevents locking lever 120 from rotation relative to first housing 110. First housing 110 is in a situation ready to receive second housing 210.

When connectors 100 and 200 are to mate together, first and second housings 110 and 210 are placed to face each other, with bosses 216 and guide groove 116 aligned along double dotted lines 12 shown in FIGS. 1, 2, 6A and 6B. Protuberances 212 of second housing 210 are then received by guide grooves 116 via end openings 112 of first housing 110.

Figure 7A:
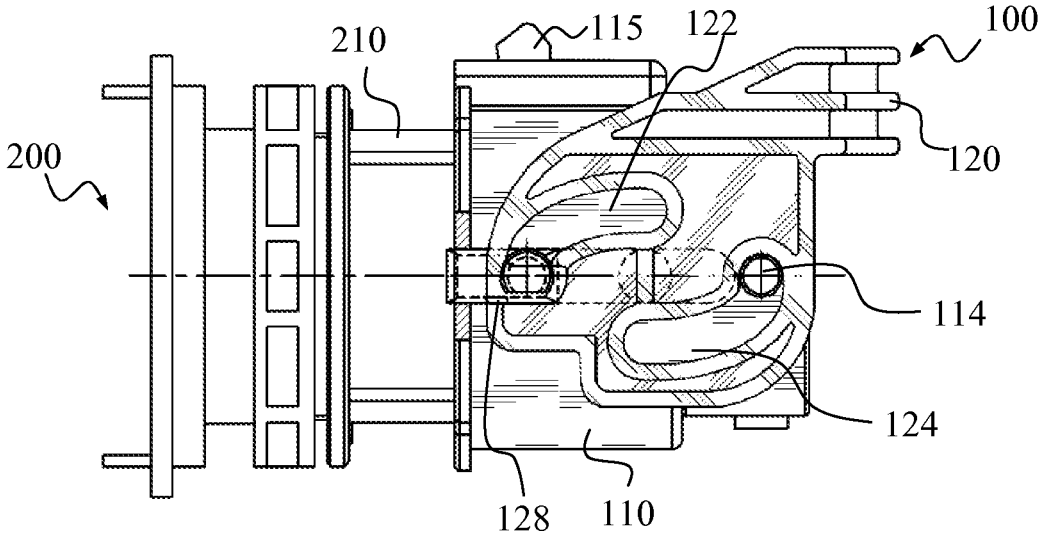
FIG. 7A is a front view showing the electrical connector assembly of FIG. 1 when and the locking lever is released.
Figure 7B:
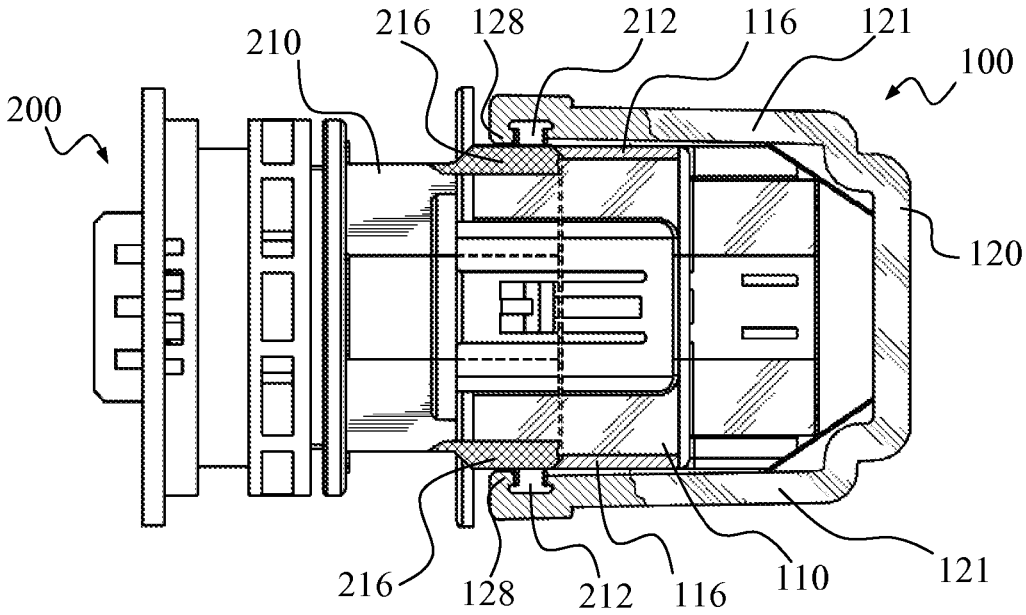
FIG. 7B is a partial cross sectional top view of FIG. 7A.
Figure 8:
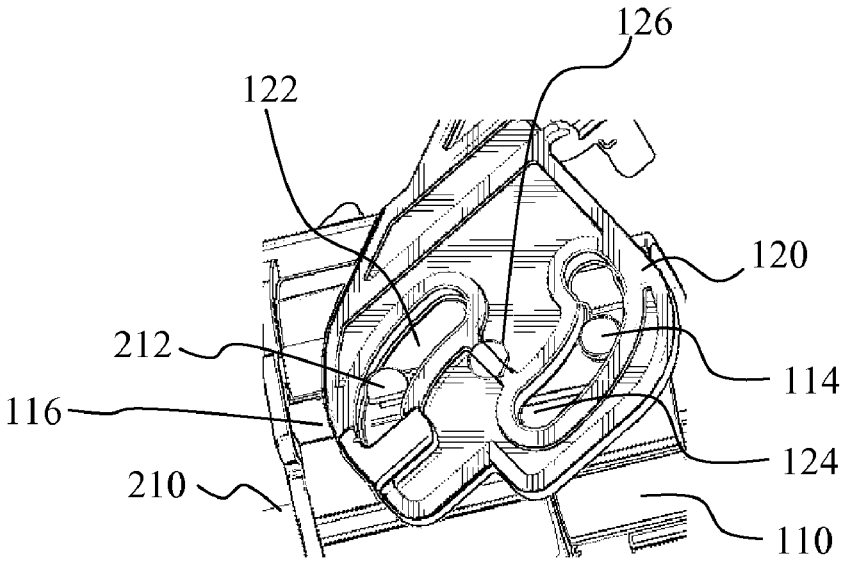
FIG. 8 is a partial perspective view showing the connector assembly of FIG. 1 when the two connectors are connected and move towards the final mating position.

By further pushing first and second connector housings 110 and 120 toward each other, as shown in FIGS. 7A and 7B, and by spacing 217 provided by partially cut-away protuberance 212, bosses 216 slides along guide grooves 116 and urge against stopper 128, causing side plates 121 to deflect away from each other. By this action, stoppers 128 are disengaged from guide grooves 116. Locking lever 120 is now released from, and becomes rotatable relative to, first housing 110, about guide pivot 126, as shown in FIG. 8. Second housing 210 is now received by first housing 110.

By rotating locking lever 120, as shown in FIG. 8, guide pivots 126 slide along respective guide grooves 116, and support groove 124 slides relative to support pivot 114. In the meantime, locking groove 122 slides relative to protuberance 212 of second housing 210 by which, first and second housings 110 and 210 are brought closer to each other toward the final mated position. By making guide pivots 126 slidable along guide grooves 116, the rotation of locking lever become easier and more effective, compared to a conventional connector in which the locking lever can only rotate relative to the housing but the pivot is fixed. In addition, the locking lever operation force distribution is better optimized, which provides a reduced operation force to bring the first and second housings 110 and 210 together.

Figure 9:
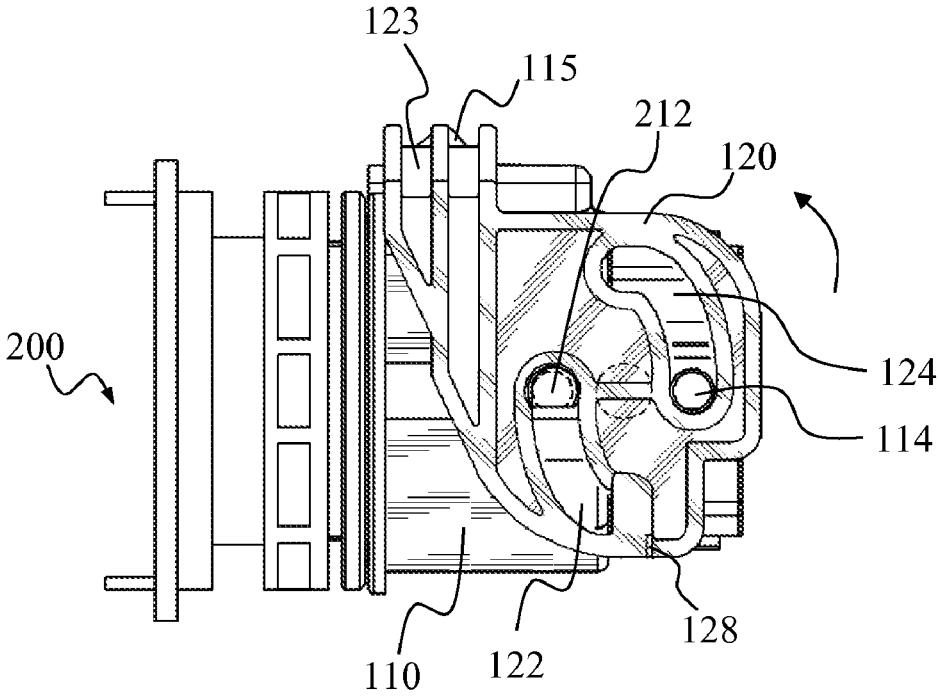
FIG. 9 is a front view showing the connector assembly of FIG. 1 when the two connectors are connected at the final mating position.

When locking lever 120 is rotated about 90 degree from the initial position, shown in FIGS. 7A and 7B, to the final position, shown in FIG. 9, connectors 100 and 200 are mated together at the final position. At the final position, cross bar 123 is locked by latch 115. Locking lever 120 is now locked at the final position at which, first and second connectors 100 and 200 are fully mated.

Although embodiments of the present invention have been illustrated in conjunction with the accompanying drawings and described in the foregoing detailed description, it should be appreciated that the invention is not limited to the embodiments disclosed, and is capable of numerous rearrangements, modifications, alternatives and substitutions without departing from the spirit of the invention as set forth and recited by the following claims.

The invention claimed is:

1. An electrical connector assembly comprising:

a first connector having a first housing and a locking lever coupled to the first housing;

a second connector having a second housing and a pair of protuberances at external surfaces of the second housing;

wherein the locking lever is movable relative to the first housing between a first position at which the locking lever allows the second housing to be received by the first housing and a second position at which the locking lever locks the first and second housings together; and wherein the locking lever has a pair of stoppers engaged to the first housing to lock the locking lever at the first position before the second housing is received by the first housing.

2. The connector assembly of claim 1, wherein the locking lever has a pair of side plates joint together by a cross bar, each side plate has a guide pivot projecting inwardly facing each other, and wherein when moving relative to the first housing the locking lever rotates about the guide pivot.

3. The connector assembly of claim 2, wherein the first housing has a pair of guide grooves each receives a protuberance of the second housing and a guide pivot of the locking lever, and wherein when the locking lever moves relative to the first housing the protuberances and the guide pivots slide relative to the guide grooves.

4. The connector assembly of claim 1, wherein the first housing has a pair of support pivots and the locking lever has a pair of support grooves each receives one of the support pivots.

5. The connector assembly of claim 4, wherein when the locking lever moves relative to the first housing the support grooves slide relative to the support pivots.

6. The connector assembly of claim 1, wherein the second housing comprises a pair of bosses each located between the housing and a respective one of the protuberances, wherein when the second housing is received by the first housing the bosses urge against the stoppers to release the stoppers from engagement with the first housing.

7. The connector assembly of claim 6, wherein each protuberance is generally cylindrical shape having a side portion partially cut away forming a space between the protuberance and an edge of the boss, wherein the space is to allow a corresponding stopper to pass through.

8. The connector assembly of claim 6, wherein the locking lever comprises a pair of locking grooves and when the second housing is received by the first housing, the pair of protuberances are received by the pair of locking grooves.

9. The connector assembly of claim 8, wherein when the locking lever moves towards the second position the pair of protuberances are engaged with the pair of locking grooves to prevent the first and second housings from separating from each other.

10. An electrical connector assembly comprising:

a first connector including a first housing and a locking lever, the first housing having a pair of guide grooves, the locking lever having a pair of side plates each having a guide pivot projecting inwardly and facing each other, the locking lever being coupled to the first housing with the pair of guide pivots received in the pair of guide grooves;

a second connector having a second housing and a pair of protuberances at external surfaces of the second housing;

wherein the locking lever is movable relative to the first housing between a first position at which the second housing is received by the first housing and a second position at which the first and second connectors are mated with each other, and wherein when the locking lever moves relative to the first housing the guide pivots slide relative to the guide grooves.

11. The connector assembly of claim 10, wherein the locking lever has a pair of locking grooves for engaging the pair of protuberances, and wherein when the locking lever moves to the second position the second housing is brought closer to the first housing by the engagement of the locking grooves and the protuberances.

12. The connector assembly of claim 11, wherein the first housing has a pair of support pivots and the locking lever has a pair of support grooves each engages one of the support pivots, wherein each guide pivot is located between a corresponding locking groove and a corresponding support groove.

13. The connector assembly of claim 12, wherein when the locking lever moves to the second position, the support pivots slide along the support grooves and the protuberances slide along the locking grooves simultaneously.

14. The connector assembly of claim 10, wherein the locking lever has a pair of stoppers engageable with the first housing to lock the locking lever at the first position before the second housing is received by the first housing.

15. The connector assembly of claim 14, wherein when the second housing is received by the first housing the stoppers are released to allow the locking lever to move to the second position.

16. The connector assembly of claim 15, wherein the second housing comprises a pair of bosses each located between the second housing and a corresponding protuberance, wherein when the second housing is received by the first housing the bosses urge against the stoppers to release the stoppers from the first housing.

17. The connector assembly of claim 16, wherein each protuberance is generally cylindrical shape having a side portion partially cut away forming a space between the protuberance and an edge of the boss, wherein the space is to allow a corresponding stopper to pass through.

* * * * *